US005383615A

United States Patent [19]

Calka et al.

[11] Patent Number: 5,383,615

[45] Date of Patent: Jan. 24, 1995

[54] BALL MILLING APPARATUS

[75] Inventors: Andrzej Calka, Ainslie; Barry W. Ninham, Cook, both of Australia

[73] Assignee: The Australian National University, Acton, Australia

[21] Appl. No.: 842,419

[22] PCT Filed: Oct. 3, 1989

[86] PCT No.: PCT/AU90/00471

§ 371 Date: Mar. 27, 1992

§ 102(e) Date: Mar. 27, 1992

[87] PCT Pub. No.: WO91/04810

PCT Pub. Date: Apr. 18, 1991

[51] Int. Cl.[6] ..... B02C 17/00; B02C 17/04

[52] U.S. Cl. ..... 241/172; 241/176; 241/179

[58] Field of Search ..... 241/171, 172, 176, 179, 241/65

[56] References Cited

U.S. PATENT DOCUMENTS

| | | | |
|---|---|---|---|
| 1,894,106 | 1/1933 | Lehrack | 241/172 |
| 2,098,054 | 11/1937 | McBerty | 241/65 |
| 2,416,746 | 3/1947 | Gavin | 241/172 |
| 2,602,594 | 7/1952 | Hesse | 241/65 |
| 3,097,802 | 7/1963 | Frankert | 241/65 |
| 4,601,431 | 7/1986 | Watanabe et al. | 241/172 |
| 4,676,439 | 6/1987 | Saito et al. | 241/172 |

*Primary Examiner*—Mark Rosenbaum
*Assistant Examiner*—John M. Husar
*Attorney, Agent, or Firm*—Harness, Dickey & Pierce

[57] ABSTRACT

A ball mill for use in mechanical alloying and grinding comprising a plurality of ferromagnetic balls within a spherical or cylindrical chamber or cell of a paramagnetic material. The chamber has a substantially horizontal axis of rotation. At least one magnet is mounted outside the chamber to produce a magnetic field within the chamber. The magnet is physically moveable, relative to the chamber, between a plurality of locations on an arc centered on the axis of rotation of the chamber.

12 Claims, 5 Drawing Sheets

BALL MILLING APPARATUS

TECHNICAL FIELD

This invention concerns ball milling and mechanical alloying. More particularly, it concerns an improved ball mill for use in grinding and in alloying (both low temperature alloying and high temperature alloying).

BACKGROUND TO THE INVENTION

Ball mills and attritors have been used for many years to produce fine powders. In ball mills, the energy input to the powder charge is provided by the rotation of the mill, a cylindrical cell or vial about a horizontal axis, so that hard balls within the mill are tumbled with, or onto, the charge in the mill. In attritors, metal arms are used to stir the ball charge.

As noted by Y S Benjamin in his article in *Scientific American,* volume 234, page 40 (1976), it was appreciated in the early 1970's that in addition to creating powders, ball milling could be used to produce solid state reactions which result in the synthesis of new alloys from elemental powders. It was also discovered that ball milling can modify an alloy structure. The first of these techniques (the synthesis of alloys) is known as "mechanical alloying"; the second technique has been termed "mechanical grinding".

When mechanical alloying is used to produce new materials, there is a combination of repeated welding, fracturing and rewelding of a mixture of powder particles having a fine microstructure together with a rapid interdiffusion process.

Both mechanical alloying and mechanical grinding have been effected using either the vibrating milling technique or the rotating milling technique. In vibrating-frame mills, hardened steel balls are caused to impact substantially vertically upon the powder charge. Local overheating of the particles can occur as a consequence of the mill structure. This local overheating is difficult to remove. In addition, the mixing of the particulates is very slow (and in some designs of mill, is almost non-existent). Thus rotating mills, in which the steel balls roll along a circular arc on the inner wall of the mill chamber or vial, are preferred for mechanical alloying.

In rotating mills, the powder charge is spread on the inner surface of the chamber. This ensures that heat generated within the chamber is removed by conduction through the cylindrical wall of the chamber and that there is effective mixing of the powder constituents. However, when using rotating mills, it is not possible to provide the impact energy of the balls that is achieved in vibrating-frame mills when a rotating ball mill is used.

DISCLOSURE OF THE PRESENT INVENTION

It is an objective of the present invention to provide an improved ball mill in which the impact energy of the vibrating-frame mill technique can be achieved while the cooling and powder mixing features of the rotating mill technique are maintained. It is a further objective of the present invention to provide a ball mill in which the energy or intensity of the milling process is variable and controllable.

These objectives are achieved by constructing the chamber of a rotating ball mill as a hollow cylinder or sphere of a paramagnetic material and mounting at least one magnet outside the chamber in a manner such that either (i) the magnet (or magnets) can be moved around the chamber along an arc centred on the axis of rotation of the chamber, or (ii) the location of the magnet (or magnets) can be varied between a number of mounting positions, each located on an arc centred on the axis of rotation of the chamber. Mounting a magnet (or magnets) in this manner creates a perturbation of the normal movement of the steel balls of the ball mill when the chamber is rotated. In particular, when a magnet is positioned vertically below the chamber, there is an increase in both the rotation of the balls in the chamber and their contact time with the powder charge of the chamber. As the magnet is moved to a position high on one side of the chamber, each ball is lifted by the magnet before being dropped on to the charge (including other balls) of the mill, to provide a high energy impact. At intermediate positions of the magnet around the chamber, the steel balls provide a combination of increased impact energy and increased contact with and mixing of the powder charge in the mill.

Thus, according to the present invention, there is provided a ball mill comprising:

(a) a substantially spherical or generally cylindrical chamber, the chamber being mounted (i) in the case of a substantially spherical chamber, for rotation about a substantially horizontal axis, and (ii) in the case of a generally cylindrical chamber, with the axis of the cylinder substantially horizontal and for rotation about the axis of the cylinder; and (b) a plurality of steel balls within the chamber; characterised in that (c) the chamber is made of a paramagnetic material;

(d) the steel of which the balls are made is a ferromagnetic material; and (e) at least one magnet is mounted outside the chamber, said or each magnet (i) having lines of magnetic force which penetrate into the chamber, and (ii) being physically moveable, relative to the chamber between a plurality of locations along an arc having its centre of curvature substantially at the axis of rotation of the chamber.

As noted above, and as will be explained in more detail later in this specification, the magnet (or magnets) may be either mounted for movement along an arc (or along respective arcs) having its (their) centre(s) of curvature at the axis of rotation of the chamber, or repositionable at a plurality of discrete locations around the chamber, each of the discrete locations being on an arc having its centre of curvature substantially at the axis of rotation of the chamber.

The magnet (or each magnet) may be an electromagnet or a permanent magnet.

For a better understanding of the present invention, embodiments of the invention will now be described, by way of example, with reference to the accompanying drawings.

DETAILED DESCRIPTION OF THE EMBODIMENTS

Figure 1:
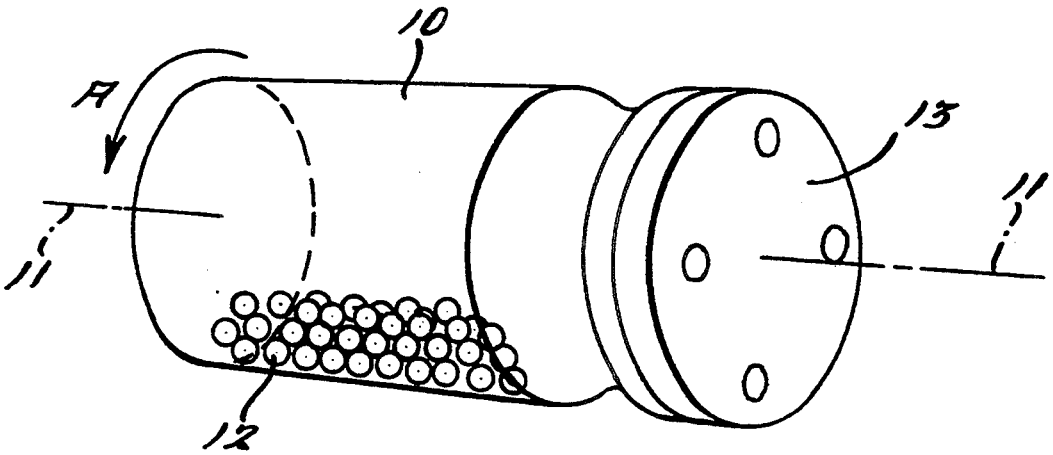
Prior Art FIG. 1.
FIG. 1 is a schematic diagram of a conventional ball mill.

The conventional ball mill shown in FIG. 1 has a cylindrical cell or chamber 10 mounted for rotation in the direction of arrow A about a horizontal axis 11. A plurality of steel balls 12 within the chamber are tumbled with the powder charge in the cylinder. Access to the chamber is through an end door 13. The operation of this type of ball mill is well known and further explanation here of its mode of operation is unnecessary.

The ball mills illustrated in FIGS. 2 to 6 each have a cylindrical or spherical cell 20 made from a hard paramagnetic alloy. The precise shape of the cell or chamber 20 is not important. The chamber 20 is rotatable about a substantially horizontal axis 21 which, in the case of a cylindrical or generally cylindrical chamber, is also the axis of the chamber. Within the cell are a number of balls 22, made from a hard ferromagnetic alloy. At least one magnet 24, which may be an electromagnet or a permanent magnet, is mounted outside the cell 20 but close enough to the cell for the field of the magnet to have a significant influence upon the ferromagnetic balls 22.

As will be apparent from FIGS. 2 to 6, the magnet or magents 24 can be repositioned relative to the chamber 20 either by movement around an arc which has its centre of curvature substantially coincident with the axis of rotation 21 of the chamber 20 or by physically moving the or each magnet from one discrete mounting location to another of a number of discrete mounting locations which are provided adjacent to the chamber 20.

The present invention may be used with a single layer of the balls 22 or the chamber 20 may contain a large number of ferromagnetic balls.

When a powder charge is loaded into the chamber 20, the powder will rapidly become uniformly distributed on the internal surface of the cell 20, with a layer of powder also on the balls 22. The mode of operation of the ball mill depends upon the required result.

Figure 2:
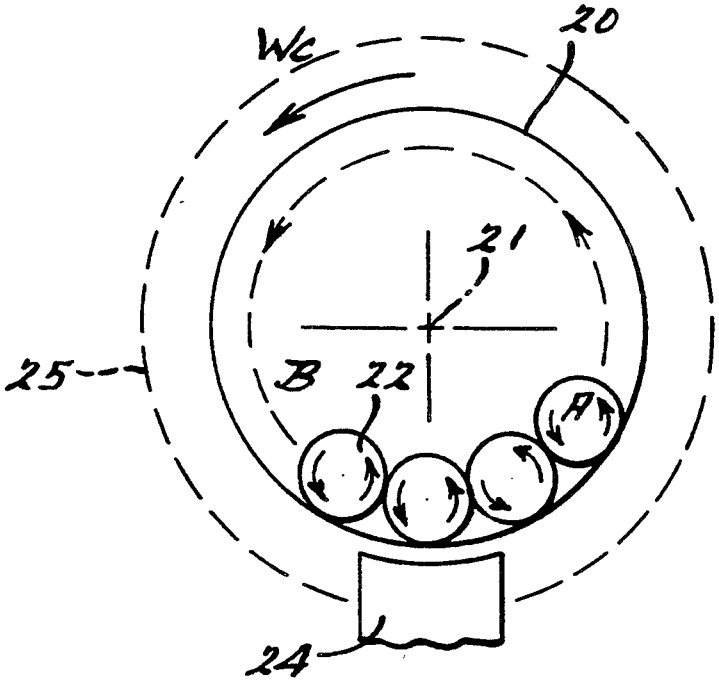
FIG. 2 illustrates a ball mill constructed in accordance with the present invention, with a single magnet located beneath the chamber of the ball mill.

If the magnet 24 is positioned immediately below the chamber 20 as shown in FIG. 2, the magnetic field established by the magnet 24 holds the balls 22 in the bottom part of the cell 20. Friction between the surface of the balls and the inner wall of the cell 20 causes the balls 22 to rotate in the same direction with a frequency $w_b$ given by the relationship $$w_b = w_c \cdot \frac{R}{r}$$

where $w_c$ is the rotational frequency of the cell, r is the radius of the balls 22 and R is the internal radius of the cell or chamber 20. Periodically, the outer ball 22 on the right side of the assembly of balls in the chamber breaks away from the pack of balls and, under the influence of centrifugal forces, performs an almost complete circular transit, along the path 28 while in contact with the inner wall of the chamber 20, to the other side of the pack of balls. At the end of this transit, it strikes the outer-most ball on the left side of the pack of balls.

In this mode of operation, the powder charge in the ball mill is worked both by impact and by a shearing action.

The balls 22 may be confined to the bottom part of the chamber 20 for the entire milling process by either (i) increasing the intensity of the magnetic field applied by the magnet 24, or (ii) decreasing the frequency of rotation of the chamber or cell 20. In this operating mode, the balls in the chamber both rotate and oscillate around their equilibrium position at the bottom of the cell 20. The powder charge in the mill, therefore, is worked mostly by shearing. This is the "low energy" mode of the ball mill. In this mode, the magnetic field of the magnet 24 causes the balls to apply a greater force to the layer of powder on the inner surface of the chamber 20 than is applied in a conventional ball mill. In addition, the contact time between the balls is increased. This results in a more effective fracturing process. Thus little welding of the constituents of the powder charge is effected in this mode of operation. However, this mode of operation of the present invention is characterised by very good mixing of the powder particles and low local temperatures, which is useful for grinding materials to reduce their particle sizes or (in the case of alloy particles) to modify their structure. This mode of operation is also useful for low temperature alloying—particularly the alloying of low melting point alloys (for example, aluminium base alloys), which leads to extended solid solubility.

Figure 3:
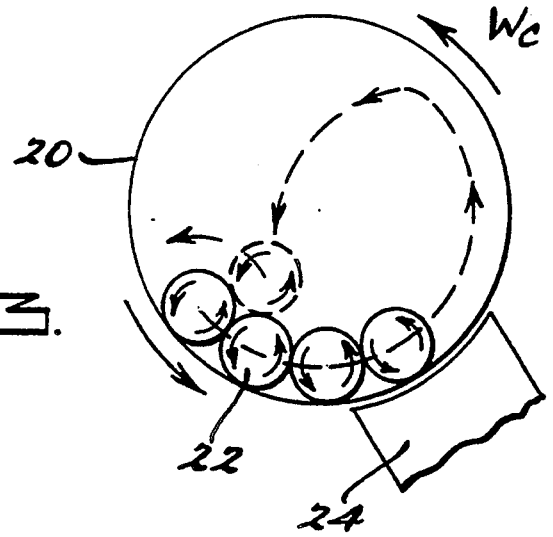
FIGS. 3 and 4 show the ball mill of FIG. 2, with the magnet in different locations along the arc of movement of the magnet.
Figure 5:
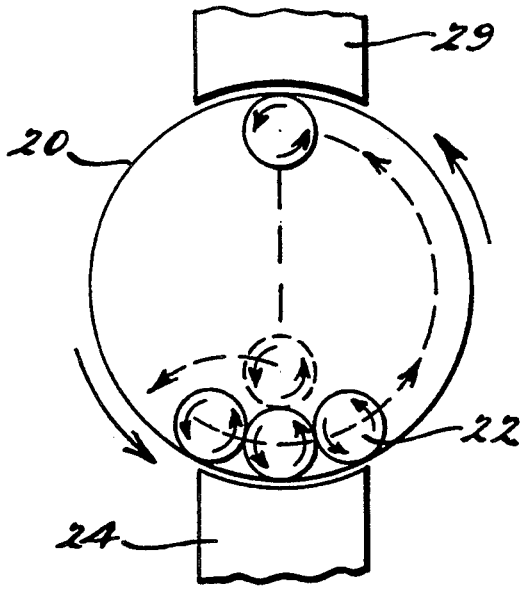
FIG. 5 depicts a ball mill with two magnets, on diametrically opposed locations around the chamber, one magnet being directly above the chamber and the other magnet being directly below the chamber.
Figure 6:
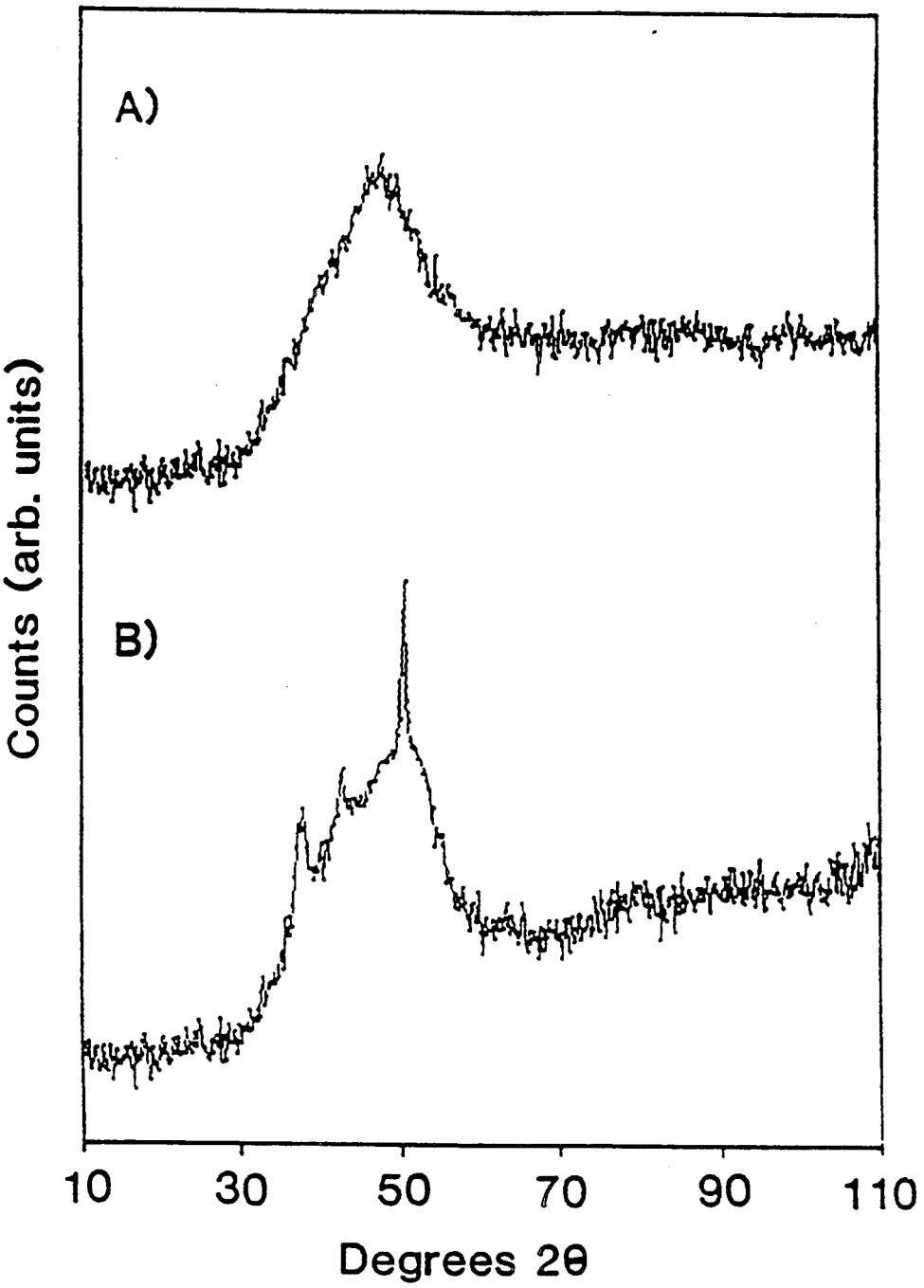
FIGS. 6 and 7 are x-ray diffractograms of different powder mixtures using the ball mill of FIGS. 2 to 5.

If, as shown in FIG. 5, a second magnet 29 is positioned diametrically opposite the magnet 24 of FIGS. 2 and 3, the circular path of each break-away ball (under centrifugal force) is halted at the highest point inside the cell. A ball trapped by the magnetic field of the magnetic field of the magnet 29 in the uppermost position within the cell can be released to fall vertically on to one of the ferromagnetic balls in the mass at the lowermost part of the chamber or cell. When this occurs, the two colliding balls are rotating in opposite directions at the point of impact, which results in a combination of shearing and uniaxial pressure at the surface of contact. This is the "high energy" mode of operation of the ball mill.

Figure 4:
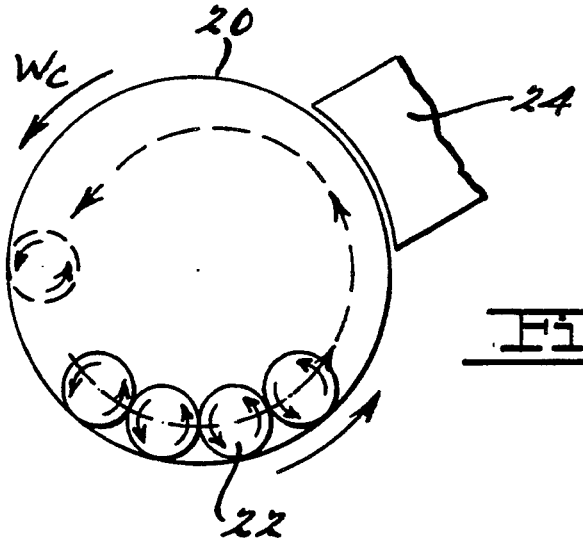

Two different modes of operation of the ball mill of the present invention are shown in FIGS. 3 and 4. By repositioning the magnet 24 and by reducing the cell rotation frequency to a value lower than the cell rotation frequency of the cell 20 when the mill is operated in the FIG. 2 or FIG. 5 mode, whenever a ball 22 is released from the mass of balls at the lower-most region of the cell, the released ball is not held continuously against the inner wall of the cell by centrifugal force. Instead, the released ball follows an arcuate path in which the ball is partly out of contact with the cell wall and another ball, and then strikes either one of the bottom balls (as shown in FIG. 3) or the opposite portion of the cell wall (as shown in FIG. 4).

When operating in the mode shown in FIG. 3, each break-away ball which has descended from the top of its path to strike a lower ball has a high rotational speed in the opposite direction to the lower ball. This is essentially the same mode of operation as that shown in FIG. 5. The impact results in a significant increase in the local temperature at the point of impact, to facilitate the effective synthesis of high melting point alloys and intermetallic phases (such as $TiB_2$, AlPd, $Al_3Pd_5$) and an extension of solid solubility in high temperature alloys (such as titanium in silicon).

In the mode of operation illustrated in FIG. 4, the magnet 24 is raised higher than in the mode of operation illustrated in FIG. 3. However, the FIG. 4 mode of operation is comparable to the mode of operation shown in FIG. 2. The ball descending from the point of highest lift strikes the internal surface of the chamber, which is rotating in the same direction as the surface of the ball. Thus the local temperature produced on impact is higher than in the mixing and grinding mode of operation but lower than in the mode of operation shown in FIGS. 3 and 5. The mode of operation shown in FIG. 4 is thus particularly suitable for medium melting point reactions, with subdued alloying. There is a combination of, or balance between, welding and fracturing. Amorphization of alloys (for example, magnesium-zinc alloys) and extension of solid solubility and creation of intermetallic phases at low and average melting point elements or alloys (such as aluminium-magnesium, aluminium-iron and magnesium-zinc) can be achieved.

Using a ball mill constructed in accordance with the present invention, and operated in the mode illustrated in FIG. 3, the alloy AlPd was obtained by the following method. Elemental powders of aluminium and palladium, having a purity of 99.99 per cent and a grain size of about 20 micrometers were milled for 66 hours in a slight overpressure of pure, dry helium. X-ray diffraction patterns obtained from the mechanically alloyed powders after different periods of milling showed the following: after milling for 45 hours, the intermetallic phase AlPd was observed and after 66 hours of milling, the mixture contained no detectable amount of elemental aluminium or palladium. However, a small quantity of the alloy $Al_3Pd_5$ was detected after 66 hours of milling. It is believed that the $Al_3Pd_5$ alloy may be due to the presence of a small amount of elemental aluminium powder being deposited on the mill walls during the milling process, so that the remaining powder became aluminium-depleted, and thus rich in palladium.

An investigation by the present inventors of the operating parameters of the ball mill of FIGS. 2 to 6 has shown that, when the ball mill of the present invention is in use, the major milling parameters are as follows;

collison time: $6.5\times10^{-5}$ sec.

Hertz radius: $4.6\times10^{-4}$ m.

Maximum impact stress: 37 Kbar.

These values are close to the corresponding values quoted for commercial vibrating mills. Thus the energy per impact in the ball mill of the present invention is comparable to the energy per impact of other devices. A significant feature of the ball mill of the present invention, however, is that in every mode of operation, the ball movement pattern is well defined and highly reproducible. This contrasts with the chaotic and generally unpredictable ball movement characteristics of most conventional milling devices.

In a further example of the use of the ball mill of the present invention, the mill was used to produce the amorphous phase of nickel-zirconium mixtures. Other workers have shown that the amorphisation of these mixtures, using different milling equipment, occurs by two paths. The amorphous phase is formed directly when either the vibrating frame or a Fritsch "Pulverisette 5" planetary mill is used, but a crystalline intermetallic phase forms initially when a different type of planetary mill is employed. In addition, it has been shown that changing the milling intensity and using different combinations of the planetary mill rotation patterns can influence the outcome of the milling.

The present inventors have produced the alloy $Ni_{62}Zr_{38}$ by both of the amorphisation paths, using two different modes of operation of the ball mill of the present invention. When the high-energy mode of FIG. 3 was used, the amorphous phase was formed directly from a powder mixture of the indicated atomic percentages of nickel and zinc. X-ray diffractrometry revealed that during the milling process, the intensity of diffraction peaks due to the elemental zirconium and nickel decreases, while a peak corresponding to the amorphous phase of the intermetallic material develops. The x-ray diffraction pattern after 60 hours of milling is shown as trace A in FIG. 6.

When the low-energy milling mode described above was used to mill the elemental powder mix, the crystalline intermetallic material was formed first, then was transformed into the amorphous phase. An x-ray diffraction pattern of the milled material after 180 hours of milling is shown as trace B in FIG. 6. After continuing the milling until the elemental powder had been milled for 240 hours, some traces of the crystalline phase remained visible on top of the amorphous phase peak of the x-ray diffraction pattern.

Figure 7:
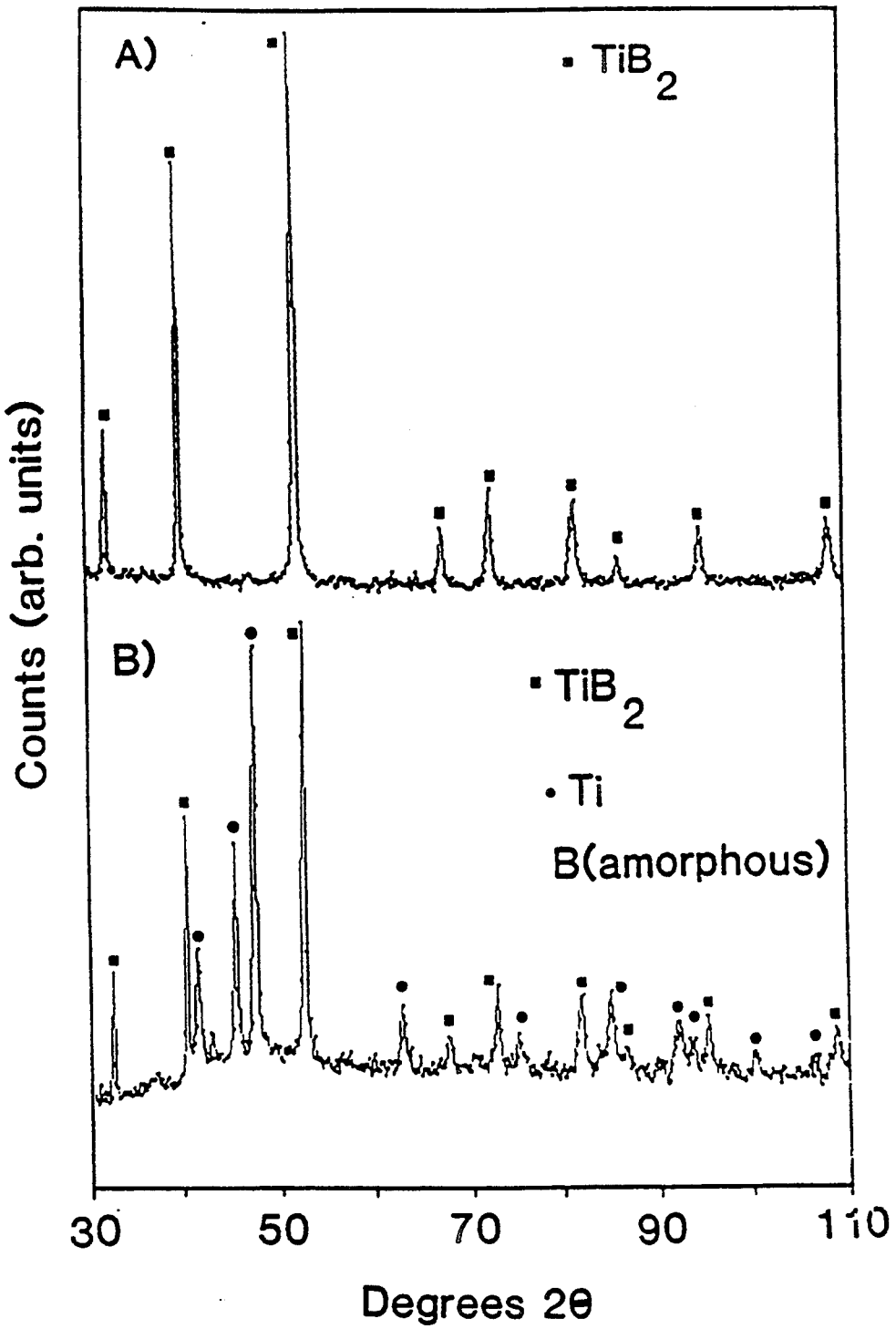
Figure 8:
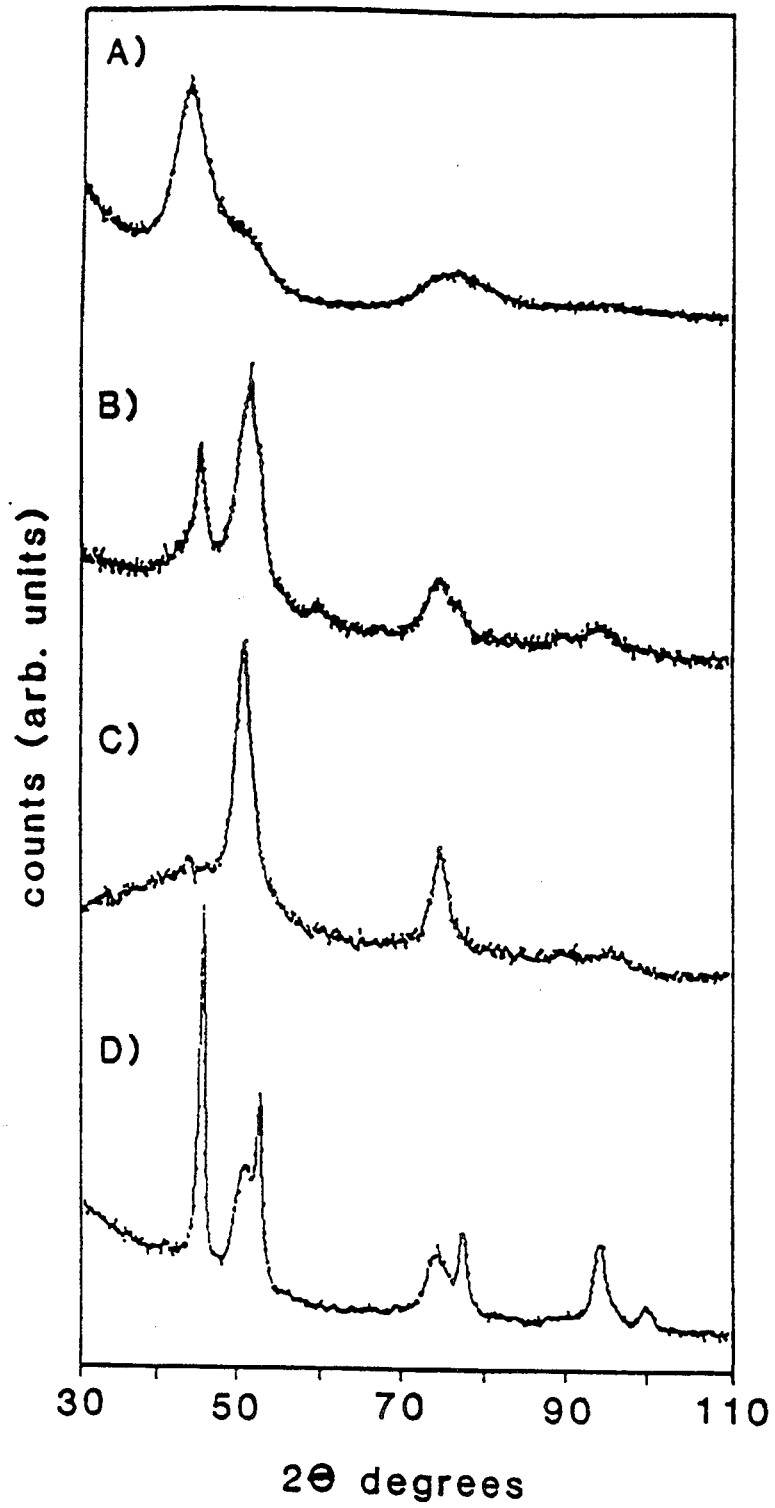
FIG. 8 is a collection of x-ray diffractograms of the product of mechanically alloyed elemental mixtures of aluminium and magnesium in the proportions $Al_{50}+Mg_{50}$, under different ball milling conditions.

The nature of alloys of titanium and boron formed by mechanical alloying are also influenced significantly by the milling conditions under which they are generated. FIG. 7 shows two x-ray diffractograms obtained from ball milling mixtures of the nominal composition of 33 atomic percent of titanium and 77 atomic percent of boron. The upper trace, trace A, was obtained from a sample milled for 80 hours using the ball mill of the present invention operated in the high energy milling mode of FIG. 3. This is the x-ray diffraction pattern of the pure $TiB_2$ phase.

The lower trace, trace B, was obtained from a sample milled for 80 hours in the same ball mill, with the same rotational frequency of the chamber of the mill, but with no magnetic field influencing the balls within the chamber (that is, the sample was milled in a conventional ball mill under notionally identical conditions). The lower diffractogram of FIG. 7 shows the presence of a mixture of crystalline titanium and a small amount of $TiB_2$. Continuing the milling in the "conventional" ball mill until the powder charge had been milled for 400 hours failed to produce a product of pure $TiB_2$.

In other experiments using the ball mill of the present invention operating in the FIG. 3 mode, powders of silicon and titanium (having a purity of 99.98 percent and a mean grain size of about 20 micrometers) were milled in an atmosphere of dry helium to produce the alloys $Ti_5Si_3$ and $TiSi_2$. The former alloy was obtained in the amorphous form, the latter in crystalline form. Similar experiments with the mill operated in the FIG. 4 mode produced highly reproducible solid solutions of up to 20 per cent titanium in silicon (this is remarkable in view of the conventional understanding that there is no solid solubility of titanium in silicon in the equilibrium state).

The present inventors have also used the ball mill of the present invention to perform amorphization of crystalline alloys. In one experiment, the magnesium-zinc alloy $Mg_{70}Zn_{30}$ was milled in the ball mill of the present invention, operated in the FIG. 2 mode of operation.

The $Mg_{70}Zn_{30}$ alloy was prepared from 99.99 percent purity components, which were melted in a tantalum crucible enclosed in a fused silica capsule. The melting was performed in an atmosphere of pure helium. The product alloy was crushed into small pieces and those pieces were milled in the ball mill of the present invention, in the FIG. 2 operating mode, with the chamber rotating at the rate of 200 revolutions per minute. Again, a slight overpressure of pure, dry helium was present in the chamber of the mill.

Samples of the milled powder were extracted at various stages during the milling and subjected to x-ray diffraction analysis. Initially, the master alloy was shown to be a mixture of crystalline phases of magnesium, MgZn and (traces only) $Mg_{51}Zn_{20}$. Continued grinding resulted in a decrease in the peaks in the x-ray diffraction pattern due to the crystalline components and the appearance of a broad peak due to the appearance of the amorphous phase. A steady state situation was achieved after 40 hours of grinding, with no change in the x-ray diffraction pattern after further grinding under the same conditions. However, further amorphization was obtained by an additional 17 hours of mechanical grinding with the mill operating under the lower energy conditions of 50 revolutions per minute.

Use of Rutherford backscattering and electron microprobe techniques to analyse the amorphous powder showed that the product powder contained the composition $Mg_{69}Zn_{30}Si_1$ or $Mg_{67.5}Zn_{32.5}$. The different compositions were estimated from the different analysis techniques. No iron or chromium contamination of the alloy from the ball mill was detected. It was concluded that the mechanical grinding had synthesised a binary magnesium alloy.

A recent modification of the ball mill of the present invention is the inclusion of means to heat the mill during the milling process, to modify the rate and nature of the reaction(s) within the ball mill.

The ball mill of FIGS. 2 to 5 has also been used to demonstrate the benefits of including a surfactant in the ball milling process, particularly in the production of aluminium-magnesium alloys.

Those familiar with mechanical grinding and alloying techniques will appreciate that in the above description, specific embodiments of the present invention have been described. However, modifications to those embodiments can be made without departing from the present inventive concept.

We claim:

1. A ball mill comprising:
(a) a substantially cylindrical chamber, the chamber being mounted with the axis of the cylinder substantially horizontal and for rotation about the axis of the cylinder; and
(b) a plurality of steel balls within the chamber; characterised in that
(c) the chamber is made of a paramagnetic material;
(d) the steel of which the balls are made is a ferromagnetic material; and
(e) at least one magnet is mounted outside the chamber, said at least one magnet (i) having lines of magnetic force which penetrate into the chamber, and (ii) being physically moveable relative to the chamber between a plurality of locations on a respective arc having its centre of curvature substantially at the axis of rotation of the chamber.

2. A ball mill as defined in claim 1, in which said at least one magnet is mounted for physical movement, relative to the chamber, along a respective arc, said arc or each arc having its centre of curvature substantially at the axis of rotation of the chamber.

3. A ball mill as defined in claim 1, in which said at least one magnet is repositionable at a plurality of discrete locations around the chamber, each one of the discrete locations being on an arc having its centre of curvature substantially at the axis of rotation of the chamber.

4. A ball mill as defined in claim 1, in which said at least one magnet is an electromagnet.

5. A ball mill as defined in claim 4, including means to vary the strength of the at least one electromagnet.

6. A ball mill as defined in claim 1, in which said at least one magnet is a permanent magnet.

7. A ball mill comprising:
(a) a substantially spherical chamber, said chamber being mounted for rotation about a substantially horizontal axis, and
(b) a plurality of steel balls within the chamber; characterised in that
(c) the chamber is made of a paramagnetic material;
(d) the steel of which the balls are made is a ferromagnetic material; and
(e) at least one magnet is mounted outside the chamber, said at least one magnet (i) having lines of magnetic force which penetrate into the chamber, and (ii) being physically moveable relative to the chamber between a plurality of locations on a respective arc having its centre of curvature substantially at the axis of rotation of the chamber.

8. A ball mill as defined in claim 7, in which said at least one magnet is mounted for physical movement relative to the chamber along a respective arc, said arc or each arc having its centre of curvature substantially at the axis of rotation of the chamber.

9. A ball mill as defined in claim 7, in which said at least one magnet is repositionable at a plurality of discrete locations around the chamber, each one of the discrete locations being on an arc having its centre of curvature substantially at the axis of rotation of the chamber.

10. A ball mill as defined in claim 7, in which said at least one magnet is an electromagnet.

11. A ball mill as defined in claim 10, including means to vary the strength of said at least one electromagnet.

12. A ball mill as defined in claim 7, in which said at least one magnet is a permanent magnet.

* * * * *

UNITED STATES PATENT AND TRADEMARK OFFICE

CERTIFICATE OF CORRECTION

PATENT NO. : 5,383,615

DATED : January 24, 1995

INVENTOR(S) : Andrzej Calka and Barry W. Ninham

It is certified that error appears in the above-indentified patent and that said Letters Patent is hereby corrected as shown below:

On the title page:

[22] PCT Filed: "Oct. 3, 1989" should be --Oct. 3, 1990--.

Please insert the following priority information:

"Priority: Australian Patent Application No. PJ6646/80 filed 3 October 1989".

Signed and Sealed this

Thirteenth Day of June, 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,383,615

DATED : January 24, 1995

INVENTOR(S) : Andrzej Calka and Barry W. Ninham

It is certified that error appears in the above-indentified patent and that said Letters Patent is hereby corrected as shown below:

On the title page:

[22] PCT Filed: "Oct. 3, 1989" should be –Oct. 3, 1990–.

Please insert the following priority information:

"Priority: Australian Patent Application No. PJ6646/89 filed 3 October 1989".

This certificate supersedes Certificate of Correction issued June 13, 1995.

Signed and Sealed this

Fifteenth Day of August, 1995

Bruce Lehman

*Attest:*

BRUCE LEHMAN

*Attesting Officer*

*Commissioner of Patents and Trademarks*